US006153154A

United States Patent [19]

Egorov et al.

[11] Patent Number: 6,153,154

[45] Date of Patent: Nov. 28, 2000

[54] METHOD FOR SEQUENTIAL INJECTION OF LIQUID SAMPLES FOR RADIOISOTOPE SEPARATIONS

[75] Inventors: Oleg B. Egorov, Richland; Jay W. Grate, West Richland; Lane A. Bray, Richland, all of Wash.

[73] Assignee: Battelle Memorial Institute, Richland, Wash.

[21] Appl. No.: 09/086,623

[22] Filed: May 27, 1998

[51] Int. Cl.[7] ..... C22B 60/00; C22B 30/00

[52] U.S. Cl. ..... 423/2; 423/2; 423/3; 423/6; 423/7

[58] Field of Search ..... 423/2, 3, DIG. 7, 423/6, 7; 250/432 PD

[56] References Cited

U.S. PATENT DOCUMENTS

| | | | |
|---|---|---|---|
| 3,576,998 | 5/1971 | Deutsch et al. | 250/106 |
| 3,740,558 | 6/1973 | Kato et al. | 250/106 T |
| 3,774,036 | 11/1973 | Gerhart | 252/301.1 R |
| 3,902,849 | 9/1975 | Barak et al. | 24/252 |
| 4,022,575 | 5/1977 | Hansen et al. | 23/230 |
| 4,177,677 | 12/1979 | Ruzicka et al. | 73/422 |
| 4,224,033 | 9/1980 | Hansen et al. | 23/230 |
| 4,314,824 | 2/1982 | Hansen et al. | 436/52 |
| 4,315,754 | 2/1982 | Ruzicka et al. | 23/230 |
| 4,399,225 | 8/1983 | Hansen et al. | 436/34 |
| 4,504,443 | 3/1985 | Hansen et al. | 422/81 |
| 4,663,129 | 5/1987 | Atcher et al. | 423/2 |
| 4,683,123 | 7/1987 | Knapp, Jr. et al. | 423/22 |
| 4,973,561 | 11/1990 | Hansen et al. | 436/52 |
| 5,154,897 | 10/1992 | Ehrhardt et al. | 423/6 |
| 5,275,802 | 1/1994 | Knapp, Jr. et al. | 424/129 |
| 5,749,042 | 5/1998 | Bray et al. | 423/2 |
| 5,854,968 | 12/1998 | Horwitz et al. | 423/2 |

FOREIGN PATENT DOCUMENTS

| | | | |
|---|---|---|---|
| 7411605 | 9/1974 | Netherlands | 250/432 PD |

OTHER PUBLICATIONS

JL Lacy, et al., "*Development and Clinical Performance of an Automated, Portable Tungsten–178 Tantalum–178 Generator.*", p. 2158–2161, 1991, no month.

CG Pippin, et al., "*Recovery–of Bi–213 From an Ac–225 Cow: Application to the Radiolabeling of Antibodies with Bi–213*", p. 315–322, 1995, no month.

A Boll, et al. "*The* $^{225}Ac^{213}$ *Biomedical Generator,*", p. 523–524, 1997, no month.

Egorov, O., et al. Flow injection renewable fiber optic sensor system, *Analyst* 1995, 120, 1950–1962.

Pollema, C.H., et al. Flow injection renewable surface immunoassay, *Anal. Chem.* 1994, 66, 1825–1831.

Ruzicka, J., et al, Jet ring cell: a tool for flow injection, *Anal. Chem.* 1993, 65, 3566–3570.

Ruzicka, J., Discovering flow injection: journey from sample to live cell and from solution to suspension, *Analyst* 1994, 119, 1925–1934.

Ruzicke, J., et al, (1999) Bioligand Interaction Assay by Flow Injection Absorptiometry, *Anal Chem.* 69, 5024–5030.

Grate, J.W., et al, (1996) Automated analysis of radionuclides in nuclear waste, *Anal. Chem.* 68, 333–340.

Willumsen, B., et al (1997) Flow Injection renewable Surface, *Anal. Chem.* 69, No. 17, 3483–3489.

Mayer, M., et al, (1996) Flow Injection Based Renewable Electrochemical Senson System, *Anal. Chem.* 68, No. 21, 3808–3814.

Holman, D.A., et al, (1997) Titration without Mixing or Dilution Sequential Injection of Chemical Sensing Membranes, *Anal. Chem,* 69, 1763–1765.

*Primary Examiner*—Steven Bos
*Attorney, Agent, or Firm*—Paul W. Zimmerman

[57] ABSTRACT

The present invention is a method of separating a short-lived daughter isotope from a longer lived parent isotope, with recovery of the parent isotope for further use. Using a system with a bi-directional pump and one or more valves, a solution of the parent isotope is processed to generate two separate solutions, one of which contains the daughter isotope, from which the parent has been removed with a high decontamination factor, and the other solution contains the recovered parent isotope. The process can be repeated on this solution of the parent isotope. The system with the fluid drive and one or more valves is controlled by a program on a microprocessor executing a series of steps to accomplish the operation. In one approach, the cow solution is passed through a separation medium that selectively retains the desired daughter isotope, while the parent isotope and the matrix pass through the medium. After washing this medium, the daughter is released from the separation medium using another solution. With the automated generator of the present invention, all solution handling steps necessary to perform a daughter/parent radionuclide separation, e.g. Bi-213 from Ac-225 "cow" solution, are performed in a consistent, enclosed, and remotely operated format. Operator exposure and spread of contamination are greatly minimized compared to the manual generator procedure described in U.S. patent application Ser. No. 08/789,973, now U.S. Pat. No. 5,749,042, herein incorporated by reference. Using 16 mCi of Ac-225 there was no detectable external contamination of the instrument components.

15 Claims, 5 Drawing Sheets

METHOD FOR SEQUENTIAL INJECTION OF LIQUID SAMPLES FOR RADIOISOTOPE SEPARATIONS

This invention was made with Government support under Contract DE-AC0676RLO1830 awarded by the U.S. Department of Energy. The Government has certain rights in the invention.

FIELD OF THE INVENTION

The present invention relates generally to the chemical separation of radionuclides. More specifically it relates to a method of automated chemical separation of one radionuclide from another, and more specifically, it relates to the automation of the separation of a short lived daughter isotope from a longer lived parent isotope, where the daughter isotope is useful in nuclear medicine.

BACKGROUND OF THE INVENTION

Separation of short lived alpha and beta emitting radionuclide daughter isotopes from long lived parent isotopes has been done for medical treatment, especially against cancer. The widespread recognition of the use of radiation to kill or neutralize unwanted cell growth such as cancer has led to increasing interest in various species of radionuclides. Of particular interest are radionuclides, such as $^{213}$Bi, which emit alpha radiation, or alpha emitters, because the alpha radiation emitted by these radionuclides does not penetrate deeply into tissue. $^{213}$Bi is normally produced as a daughter product of $^{229}$Th($t_{1/2}$=7300 y). The radioactive decay chain in which $^{213}$Bi is found is well known: $^{233}$U($1.62\times10^5$ yr $t_{1/2}$) to $^{229}$Th to $^{225}$Ra(14.8 day $t_{1/2}$) to $^{225}$Ac(10 day $t_{1/2}$) to $^{213}$Bi 47 min $t_{1/2}$). The daughters of interest for biological applications include $^{225}$Ra which decays to $^{225}$Ac. $^{225}$Ac in turn decays through a series of steps to $^{213}$Bi($t_{1/2}$=45.6 m).

Briefly, by placing alpha emitters adjacent to unwanted cell growth, such as a tumor, the tumor may be exposed to the alpha radiation without undue exposure of surrounding healthy tissue. In many such schemes, the alpha emitter is placed adjacent to the tumor site by binding the alpha emitter to a chelator which is in turn bound to a monoclonal antibody which will seek out the tumor site within the body. Unfortunately, in many instances, the chelator will also bind to metals other than the desired alpha emitter. It is therefore desirable that the number of monoclonal antibodies bonded to metals other than the desired alpha emitter be minimized. Thus, it is desirable that the alpha emitter be highly purified from other metal cations. In addition, alpha emitters such as $^{213}$Bi(47 min $t_{1/2}$) have very short half-lives. Thus, to utilize these short lived radionuclides effectively in medical applications, they must be efficiently separated from other metals or contaminants in a short period of time to maximize the amount of the alpha emitter available. Moreover, there exists low abundance, low energy Remissions associated with $^{213}$Bi that are useful for patient imaging. A more detailed description of the use of such radionuclides is found in numerous articles including Pippin, C. Greg, Otto A. Gansow, Martin W. Brechbiel, Luther Koch, R. Molinet, Jaques van Geel, C. Apostolidis, Maurits W. Geerlings, and David A. Scheinberg. 1995. "Recovery of Bi-213 from an Ac-225 Cow: Application to the Radiolabeling of Antibodies with Bi-213", *Chemists' Views of Imaging Centers,* Edited by A. M. Emran, Pleaum Press, New York, N.Y. (Pippin, 1995).

In 1996, Dr. David Scheinberg of the Memorial Sloan-Kettering Cancer Center, New York, N.Y., began administering $^{213}$Bi to a patient for treatment of acute leukemia. $^{213}$Bi is an alpha emitter which can be linked to a monoclonal antibody, "an engineered protein molecule" that when attached to the outside of the cell membrane—can deliver radioactive $^{213}$Bi, an alpha emitter with a half-life of 47 minutes. This initial trial represented the first use of alpha therapy for human cancer treatment in the U.S.

Various methods to separate bismuth from other radionuclides have been developed over the last few years. Recent work designed to develop Bi generators has focused on the use of an actinium-loaded organic cation exchange resin (Pippin, 1995; Wu, C., M. W. Brechbiel, and O. A. Gansow. 1996. *An Improved Generator for the Production of Bi*-213 *from Ac*-225, American Chemical Society Meeting, Orlando, Fla., August, 1996 (Wu, 1996); and Mirzadeh, S., Stephen J. Kennel, and Rose A. Boll. 1996. *Optimization of Radiolabeling of Immunoproteins with Bi*-213, American Chemical Society Meeting, Orlando, Fla., August, 1996). The major problem with the organic cation exchange method is that, with the need for larger amounts of "$^{225}$Ac cow" (>20 mCi), the generator is limited by the early destruction of the actinium-loaded organic cation exchange resin. Attempts to minimize this destruction have been employed by Dr. Wu at the National Institute of Health (Wu, 1996) and Dr. Ron Finn (Finn, R., M. McDevitt, D. Scheinberg, J. Jurcic, S. Larson, G. Sgouros, J. Humm, and M. Curcio (MSKCC); M. Brechbiel and O. Gansow (NIH); M. Geerlings, Sr. (Pharmactinium Inc., Wilmington, Del.); and C. Apostolidis, and R. Molinet (European Commission, Joint Research Centre, Institute for Transruanium Elements, Karlsruhe, FRG.). 1997. "Refinements and Improvements for Bismuth-213 Production and Use as a Targeted Therapeutic Radiopharmaceutical", *J. Labelled Compounds and Radiopharmaceuticals, XL,* p. 293 (MSKCC, 1997)). Instead of loading the $^{225}$Ac as a "point" source on the top surface of a cation exchange column (Karlsruhe approach), the actinium is exchanged onto a portion of the organic resin in a batch mode. The loaded ion exchange beads are then mixed with non-loaded beads to "dilute" the destructive effect, when placed in an ion exchange column used for Bi separation. The $^{213}$Bi that is eluted from the generator is chemically reactive and antibody radiolabeling efficiencies in excess of 80% (decay corrected) are readily achieved. The entire process including the radiolabeling of the monoclonal antibody takes place at abient temperature within 20–25 minutes. The immunoreactivity of the product has been determined at a nominal value of 80%. The resultant radiopharmaceutical is pyrogen-free and sterile. However, under this approach, the preparation of the "cow" prior to separation of the Bi from the organic resin is time consuming and may not meet ALARA radiation standards. In addition, the $^{225}$Ac remains associated with the organic resin during the life time of the generator (~20 days) releasing organic fragments into the $^{213}$Bi product solution each time the "cow" is milked.

The Karlsruhe radionuclide generator described in Koch, 1997 was developed in support of Dr. David Scheinberg's (Memorial Soan-Kettering Cancer Center (MSKCC), New York, N.Y.) linking 213Bi to a recombinant humanized M195 (HuM195) antibody. All 225 Ac was loaded on an inlet edge of an AGMP-50 cation exchange resin column. Because of radiation damage to the ion exchange column and resin, MSKCC altered the Karlsruhe radionuclide generator to spread the 225Ac throughout the resin bed. This alteration reduced local radiation damage, but because the 225Ac is maintained in the resin, the resin does suffer damage from the alpha activity.

An inorganic ion exchange "generator" concept, has been developed by Gary Strathearn, Isotope Products Laboratories, Burbank, Calif. and is described (Ramirez Ana. R. and Gary E. Strathearn. 1996. *Generator System Development of Ra-*223. *Bi-*212, *and Bi-*214 *Therapeutic Alpha-Emitting Radionuclides,* American Chemical Society Meeting, Orlando, Fla., August, 1996 (Ramirez, 1996)). In this approach, inorganic polyfunctional cation exchangers are used to avoid damage from the intense alpha bombardment. A column of Alphasept 1™ is pretreated with nitric acid ($HNO_3$), the $^{225}Ac$ in 1M $HNO_3$ feed is then loaded on to the column and the $^{213}Bi$ product is eluted with 1M $HNO_3$. The product $HNO_3$ must then be evaporated to dryness to remove the nitric acid. It is then brought back into solution with a suitable buffered solution to prepare the final binding of the alpha emitter to a chelator and monocolyl antibody. The evaporation step extends the time required to prepare the final product and limits the usefulness of this approach.

An anion exchange bismuth separator and method was developed as described in U.S. patent application Ser. No. 08/789,973, now U.S. Pat. No. 5,749,042. The method requires hand operation of syringes and therefore has the disadvantage of needing technical labor with the inherent possibility of radioactive exposure to the laborer.

Because of the need for increasing amounts of therapeutic radionuclides, there is a need for a method of rapid and safe (low operator exposure) separation and purification of daughter radioisotopes from parent radioisotopes, for example $^{213}Bi$ from $^{229}Th$.

SUMMARY OF THE INVENTION

The present invention is a method of separating a short-lived daughter isotope from a longer lived parent isotope, with recovery of the parent isotope for further use. Using a system with a bi-directional pump and one or more valves, a solution of the parent isotope is processed to generate two separate solutions, one of which contains the daughter isotope, from which the parent has been removed with a high decontamination factor, and the other solution contains the recovered parent isotope. The process can be repeated on this solution of the parent isotope. The system with the fluid drive and one or more valves is controlled by a program on a microprocessor executing a series of steps to accomplish the operation.

In one approach, the cow solution is passed through a separation medium that selectively retains the desired daughter isotope, while the parent isotope and the matrix pass through the medium. After washing this medium, the daughter is released from the separation medium using another solution.

With the automated generator of the present invention, all solution handling steps necessary to perform a daughter/parent radionuclide separation, e.g. Bi-213 from Ac-225 "cow" solution, are performed in a consistent, enclosed, and remotely operate apparatus. Operator exposure and spread of contamination are greatly minimized compared to the manual generator procedure described in U.S patent application Ser. No. 08/789,973 herein incorporated by reference. Using 16 mCi of Ac-225, there was no detectable external contamination of the instrument components.

It is an object of the present invention to separate and purify a shorter lived daughter isotope from a longer lived parent isotope in an automated system, recovering the parent isotope for future use.

It is an object of this invention that the parent isotope can be reused to recover more daughter isotope at a later time, with no manual manipulation of the parent isotope involved.

It is an object of this invention that the radiolytic exposure of the separation medium is minimized.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

Figure 1:
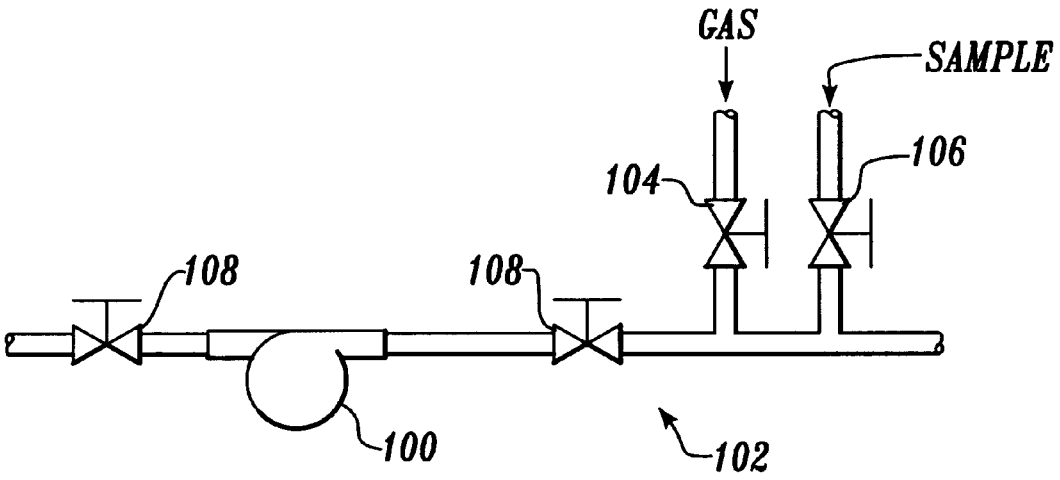
FIG. 1 is a schematic diagram of the apparatus of the present invention with separate valves.

The apparatus of the present invention is shown in FIG. 1. A bi-directional pump 100 is connected to a tubing segment 102. The bi-directional pump 100 and tubing segment 102 are filled with a buffer liquid (not shown). A first valve 104 is connected to the tubing segment 102 and connected to a gas supply (not shown) for drawing a volume of a gas in contact with the buffer liquid. A second valve 106 is connected to the tubing segment permitting drawing a first liquid sample (not shown) of a mixture of said short lived daughter isotope and said long lived parent isotope into the tubing segment by withdrawing an amount of the buffer liquid. The first liquid sample is prevented from contacting the buffer liquid by the volume of gas therebetween. The size (inside diameter) of the tubing segment and other tubing is selected so that the surface tension of liquids in cooperation with the inside diameter is sufficient in the presence of a gas to prevent flow of the liquid past the gas. Isolation valves 108 may be included.

Figure 2:
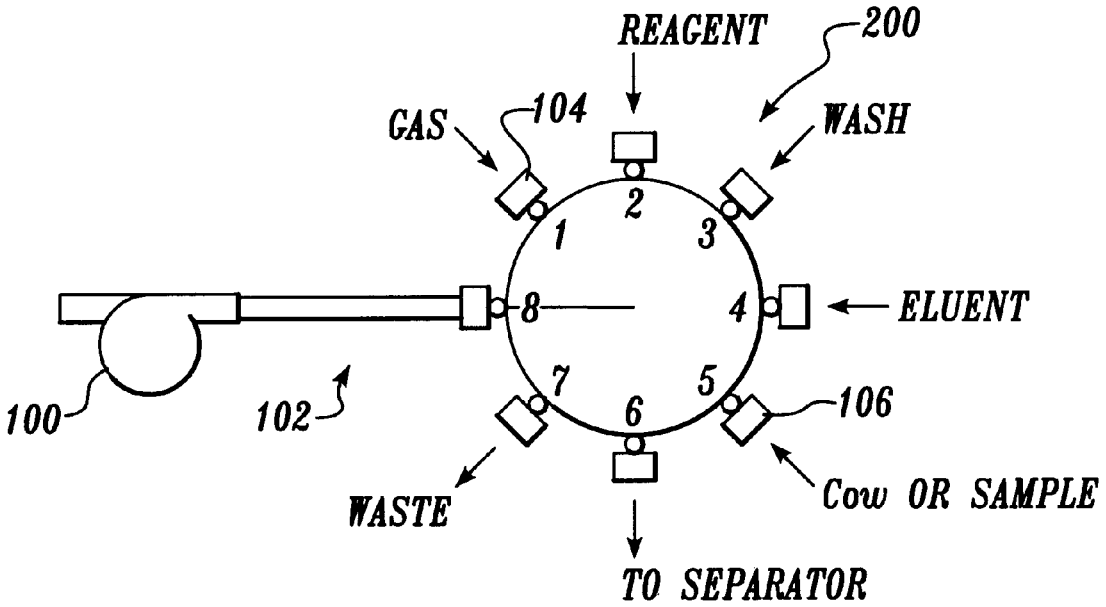
FIG. 2 is a schematic diagram of the apparatus of the present invention with a multiposition valve.
Figure 3A:
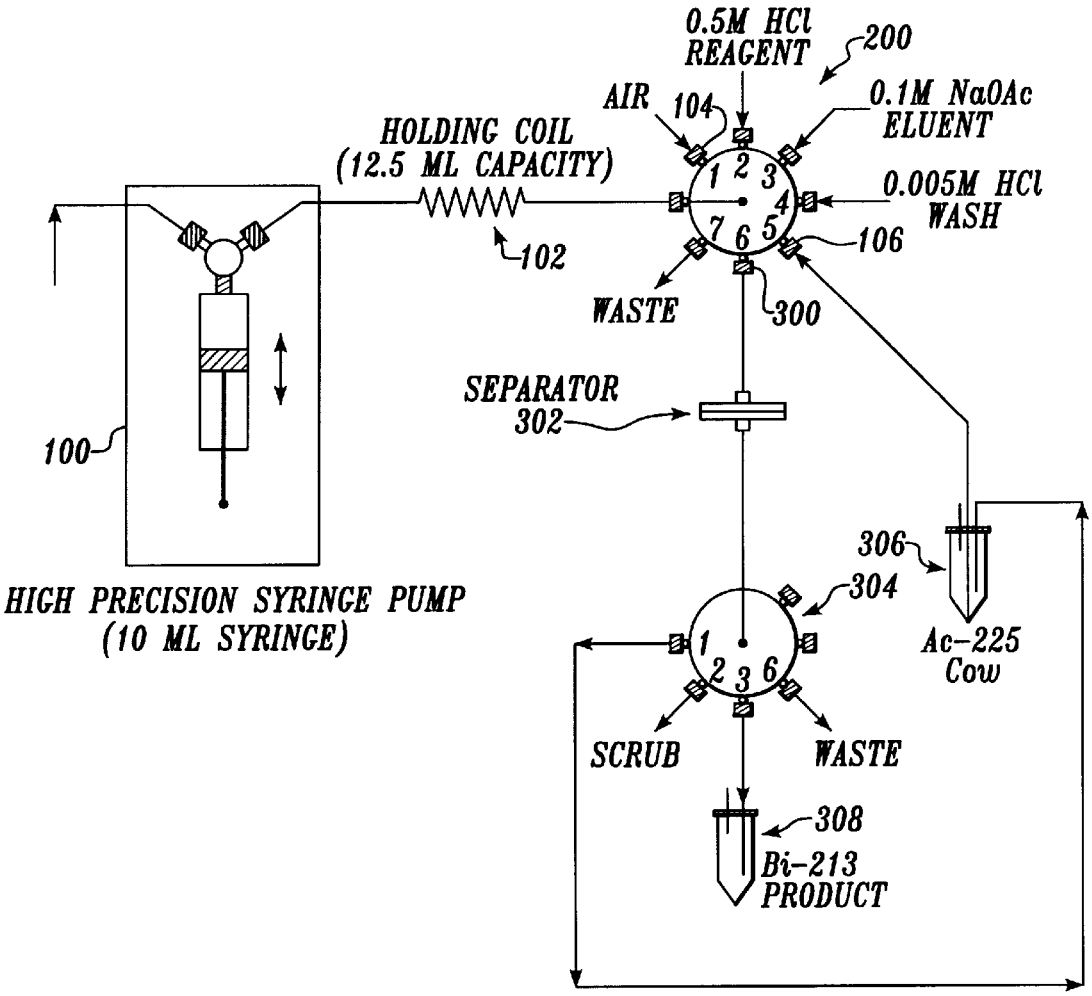
FIG. 3*a* is a schematic diagram of a system apparatus of the present invention with two multiposition valves and a separator.

Because additional streams, for example wash stream, eluent stream, waste stream, reagent stream are needed for full operation of a separation system, it is preferred that the valves 104, 106, and others connected to the tubing segment 102 for the additional streams be collected into a multiposition valve 200 as shown in FIG. 2 A complete system for separating Bi-213 from Ac-225 is shown in FIG. 3*a*. The bi-directional pump 100 is a high precision digital syringe pump (syringe volume 10 mL) (Alitea USA, Medina Wash.). The tubing segment 102 is a coil connected to a first multiposition valve 200 containing the gas valve or port 104, the sample or cow valve or port 106 and others as shown. An outlet port 300 directs fluids to a separator 302. The separator outlet is connected to a second multiposition valve 304. A cow reservoir 306 is connected to ports on both the first and second multiposition valves. A product reservior 308 collects the desired radionuclide solution. For separating Bi-213 from Ac-225, the separator 302 is an anion exchange membrane.

Figure 3B:
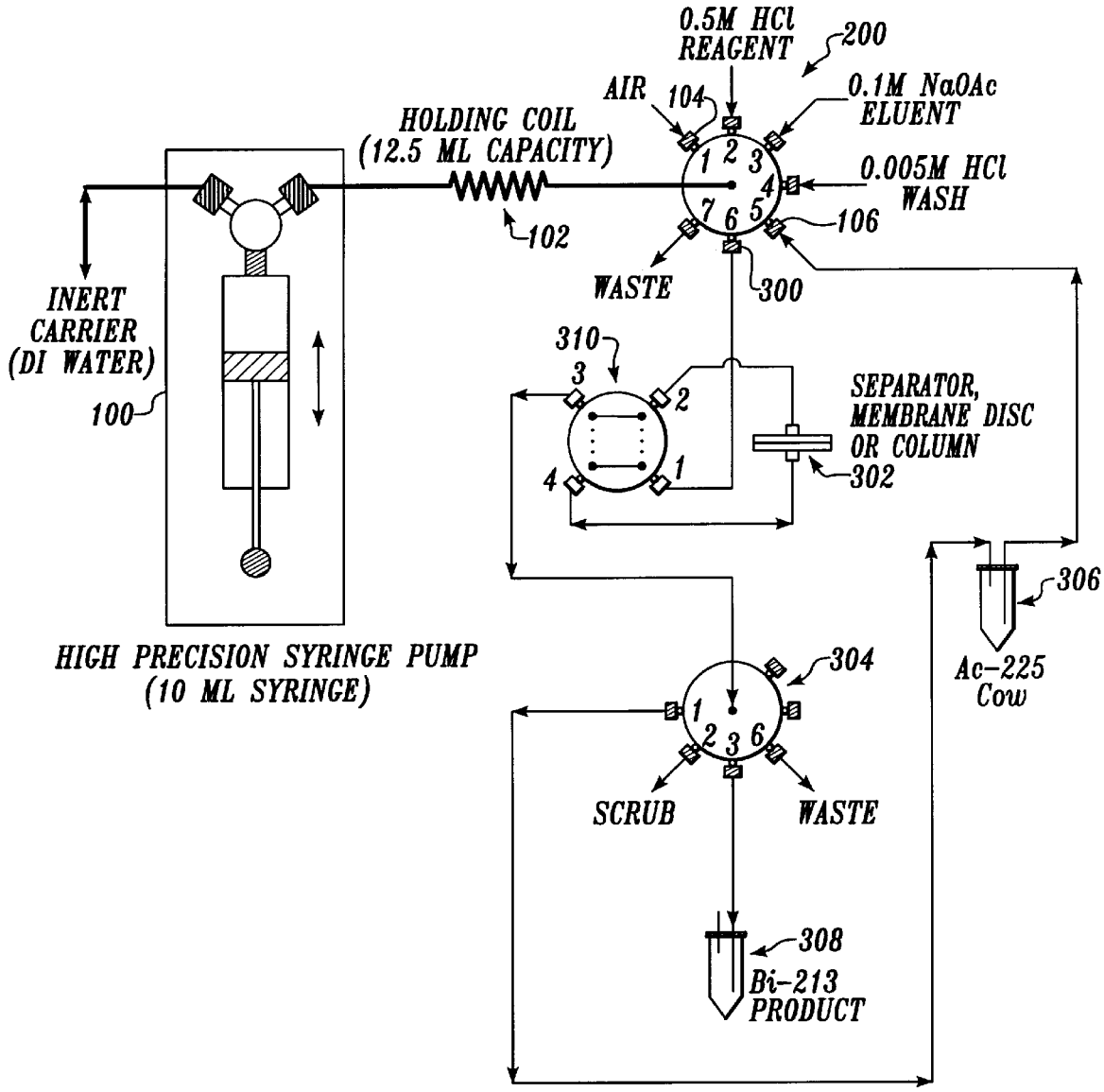
FIG. 3*b* is a schematic diagram of the system apparatus as in FIG. 3*a,* but with an optional two-position valve.

An alternative embodiment is shown in FIG. 3*b* including a 4 port two-position valve 310. In this embodiment, the first multiposition valve 200 is connected to a separation reactor port (two-position valve 310, port 1) and a stack of zones is delivered from the tubing segment 102 through the two-position valve 310 to the separator 302 at a specified flow rate. The purpose of the two-position valve 310 is to provide for the possibility of flow direction reversal through the separator 302. The two-position valve 310 is optional.

A preferred material for separation is an anion absorbing resin in the form of an membrane system, provided by 3M, St. Paul, Minn. The membrane system has a paper thin organic membrane containing the anion exchange resin, incorporated into a cartridge. The anion exchange resin, Anex, from Sarasep Corp., Santa Clara, Calif.; is ground to a powder and is secured in a PTFE (polytrifluoroethylene) membrane in accordance with the method described in a 3M, U.S. Pat. No. 5,071,610 herein incorporated by reference. For our testing, the cartridge was 25 mm in diameter. Both the cartridge size and the type of anion exchange resin used can be varied depending on the size required by the generator. Alternatively, the anion exchange resin may be in the form of particles placed in a column. Size of the cartridge or column may be determined by the desired exchange capacity.

All valves are preferably non-metallic, for example CHEMINERT® (CHEMINERT is a registered trademark of Valco Instrument Company, Inc. Also, reagent and transport lines including the tubing segment 102 are preferably non-metallic and chemically inert, for example, polytetrafluoroethylene TEFLON®, TEFLON is a registered trademark of E.I. DuPont de Nemours and Company, polyvinylidene fluoride resin KYNAR®, KYNAR is a, registered trademark of Pennwalt Corporation, polyetherethylketone (PEEK) and combinations thereof.

The pump and valves are controlled remotely from a microprocessor. Any microprocessor and operating software may be used, for example a lap-top PC using FIALAB software (Alitea).

The method of the present invention is for separating a short lived daughter isotope from a long lived parent isotope, and has the steps of:

(a) filling a bi-directional pump connected and a tubing segment connected thereto with a buffer liquid;

(b) drawing a volume of a gas in contact with the buffer liquid by withdrawing a first amount of said liquid buffer; and (c) drawing a first liquid sample of a mixture of said short lived daughter isotope and said long lived parent isotope into the tubing segment by withdrawing a second amount of the buffer liquid, wherein said first liquid sample is separated from said buffer liquid by the volume of the gas.

For separation of daughter radionuclides from parent radionuclides, details of these steps as well as additional steps are system initialization (sequential), separator conditioning, scrub and cow loading and delivery through the separator, and daughter collection.

Specifically, a Bi generator can have as the starting material either $^{225}$Ac, separated from the parents, or a mixture of $^{225}$Ra/$^{225}$Ac. There are advantages and disadvantages to the use of $^{225}$Ra as a starting material. If $^{225}$Ra is not separated from the $^{225}$Ac, the amount of Bi in terms of available radioactivity as a function of time is greatly extended. However, if the $^{225}$Ra also contains a fraction of $^{224}$Ra, because the original thorium "cow" contained both $^{229}$Th and a small percent of $^{228}$Th, separation to remove the radium is desirable.

The apparatus of the present invention may be used in two modes, stacking and sequential. The stacking mode has multiple "slugs" of liquid separated by multiple "slugs" of gas, whereas the sequential mode has only one "slug" of gas to separate sequentially loaded "slugs" of liquid from the buffer liquid.

For separation of Bi-213 from Ac-225 (without $^{225}$Ra), the steps using the apparatus of the present invention are:

1. System Initialization (sequential).

1.1 Valve 200 in waste position (port 7). Syringe is emptied at 10 mL/min.

1.2 0.250 mL air segment is aspirated into the holding coil at 10 mL/min.

This step was used to insure that only air segment is present in the holding coil and in the main line of multiposition valve A prior to solution delivery. This step eliminates any potential for contamination of reagent solutions with carrier solvent, and was used as a precaution.

2a. Separator conditioning (Stacked).

2a.1. gas, preferably air, is drawn or pulled into the tubing segment 102 through valve 104 (port 1 on first multiposition valve 200), preferably about 2 mL at about 10 mL/min flow rate.

2a.2. a membrane conditioning reagent (same as liquid containing "cow" but without the "cow") is drawn into the tubing segment 102 through valve 200, port 2, preferably 4 mL of 0.5 HCl at 10 mL/min flow rate.

2a.3. the membrane conditioning agent is expelled from the tubing segment 102, through the separator 302 (valve 200, port 6) to waste (valve 304, port 6), followed by air, preferably about 1.9 mL air at about 4 mL/min flow rate. Flow direction: down-flow (In FIG. 3*b,* ports 1 and 2 on the 2-way valve are connected).

2a.4. Valve 200 is switched to waste (port 7) and remaining air (about 0.1 mL) is expelled from the tubing segment 102 to waste, followed by 0.5 mL of carrier solution. The flow rate is preferably about 10 mL/min. Carrier solution is a liquid that does not wet the tubing and/or valve internal surface(s). The preferred carrier solution is deionized water. For clinical applications, the carrier solution can be a sanitizing solution (e.g., 50–80% ethanol solution). By utilizing ethanol solution as a carrier solution, the generator instrument can be maintained sterile. By washing the tubing with ethanol its tendency to wet is minimized.

At this point the separator 304 is conditioned and ready for separation. All transport lines and the separator 304 are filled with air.

2b. Separator conditioning (Sequential).

2b.1 Gas, preferably air is pulled into the tubing segment 102 through valve 200, port 1, preferably about 1 mL at about 18 mL/min flow rate.

2b.2 Membrane conditioning reagent is aspirated from valve 200, port 2 into the tubing segment 102, preferably about 4 mL of about 0.5 HCl at about 18 mL/min flow rate.

2b.3 The membrane conditioning reagent is expelled from the tubing segment 102, through the separator 302 (valve 200, port 6) to waste (valve 304, port 6), followed by air, preferably about 1 mL with a flow rate of about 8 mL/min. Flow direction: down-flow (ports 1 and 2 on the 2-way valve 310 (FIG. 3*b*) are connected).

2b.4 Air is aspirated through valve 200, port 1 into the tubing segment 102, preferably about 10 mL at about 18 mL/min flow rate.

2b.5 Valve 200 is switched to membrane position (port 6). About 10 mL of air is expelled through the separator 302 at about 15 mL/min flow rate to waste (valve 304, port 6).

3a. Load and Delivery of the "cow" and scrub solutions into the tubing segment (stacked).

Load Scrub and "Cow" (stacked)

3a.1. Air is pulled into the tubing segment 102 through valve 200, port 1, preferably about 2 mL at about 10 mL/min flow rate.

3a.2. Scrub solution is pulled into the tubing segment 102 through valve 200, port 4, preferably about 4 mL of about 0.005 M HCl at about 10 mL/min flow rate.

3a.3. Air is pulled into the tubing segment 102, preferably about 2 mL at about 10 mL/min.

3a.4. "Cow" solution is drawn through valve 200, port 5 into the tubing segment 102, preferably about 4 mL at about 4 mL/min flow rate. Note that the "cow" volume is only about 3 mL. Aspiration of about 4 mL volume insures quantitative transfer of the cow solution into the tubing segment 102.

At this point the tubing segment 102 contains sequentially stacked zones of "cow" and scrub solutions separated with the air segments. Alternatively, Deliver "Cow" and Scrub (stacked)

3a.5. Multiposition valve 304 is in the "cow" position (port 1)

3a.6. Multiposition valve 200 is in the membrane position (port 6)

3a.7. Two-position valve 310 (optional) is switched to up-flow position (ports 1 and 4 are connected)

3a.8 "Cow" solution and air (preferably about 1.8 mL) are delivered to the separator 302 and the effluent is directed to the original "cow" storage container or reservior 306 through valve 304 (port 1). This step is accomplished by dispensing about 6.350 mL from the holding coil at 4 mL/min flow rate.

(Note that the actual volumes and dispensed volumes are different. The dispensed volumes were found experimentally in cold tests and account for the elasticity of the air segments stacked in the holding coil. We confirmed that the overall reproducibility of the solution handling was not affected.)

3a.9. Multiposition valve 304 is in the scrub position (port 2).

3a.10. Scrub solution (preferably about 4 mL of about 0.005 M HCl) and air (preferably about 1.9 mL) are delivered to the separator 302 and directed to valve 304 (port 2). The scrub fraction is collected for subsequent analysis.

3a.11. Valve 200 is switched to waste (port 7) and remaining air (about 0.1 mL) is expelled from the holding coil to waste, followed by the carrier solution (about 0.5 mL). The flow rate is preferably about 10 mL/min.

At this point, Bi-213 is retained on the anion exchange membrane within the separator 302 and is separated from the parent Ac-225. The Ac-225 "cow" solution is recovered in the original storage vial or reservoir 306. The separator 302 and transport lines are flushed with air. The separator 302 is ready for Bi-213 elution.

3b. Load and Delivery of "cow" and scrub solutions into the tubing segment (sequential).

Load and Deliver "Cow" (sequential)

3b.1 Air is aspirated through valve 200, port 1 into the tubing segment 102, preferably about 1 mL at about 10 mL/min.

3b.2 Valve 200 is switched to "cow" position (port 5). About 4 mL cow is drawn into the tubing segment 102 at about 4 mL/min flow rate. Ac-225 "cow" solution volume is nominally 3.1 mL. Aspiration of about 4 mL insures quantitative transport of the "cow" solution into the tubing segment 102.

3b.3 Operator is requested to confirm further proceeding with the automated separation.

3b.4 Valve 200 is switched to the membrane position (port 6). Valve 304 is switched to "cow" return position (port 1). Two-position valve 310 is switched to up-flow position (ports 1 and 4 are connected).

3b.5 About 5 mL is expelled from the tubing segment 102 to cow storage vial 306 (Valve 304, port 1) at about 4 mL/min flow rate. Ac-225 "Cow" solution is propelled through the separator 302 and is returned to the storage vial 306.

3b.6 Valve 200 is switched to "air" position (port 1). About 10 mL of air is aspirated into the tubing segment 102 at about 8 mL/min flow rate.

3b.7 Valve 200 is switched to membrane position (port 6). Two-position valve xx is switched to down-flow position (ports 1 and 2 are connected).

3b.8 About 10 mL of air is expelled from the tubing segment 102 to the "cow" storage vial 306 through valve 304, port 1 at about 15 mL/min flow rate.

At this point Bi-213 is loaded into the separator 302, Ac-225 solution is returned to the original storage vial 306.

Load and Deliver Scrub (sequential)

3b.9 Valve 200 is switched to air position (port 1). Valve 304 is switched to lo scrub position (port 2). **3*b*.10 Air is aspirated into the tubing segment 102 through valve 200**, port 1 preferably about 1 mL at about 10 mL/min.

3b.11 Valve 200 is switched to scrub position (port 4). About 4 mL of scrub solution is pulled into the tubing segment 102 at about 20 mL/min.

3b.12 Valve 200 is switched to membrane position (port 6). About 5 mL is expelled from the tubing segment 102 through the separator 302 to scrub position of Valve 304, port 2 at about 6 mL/min (up-flow direction through the separator 302).

3b.13 Valve 200 is switched to "air" position (port 1). About 10 mL of air is aspirated into the tubing segment 102 at about 18 mL/min.

3b.14 Valve 200 is switched to separator position. About 10 mL of air is expelled from the tubing segment 102 to waste (valve 304, port 6) at about 15 mL/min.

4a. Bi-213 elution sequence (stacked)

4a.1. Two position valve 310 is switched. The flow direction through the separator 302 is reversed for Bi-213 elution (down flow, ports 1 and 2 on two-position valve 310 are connected)

Note, that flow direction through the separator 302 is reversed relative to Ac-225 load and scrub (wash) steps. 4a.2 Multiposition valve 304 is set in the Bi-213 product position (port 3)

4a.3. An air segment is pulled into the tubing segment 102 through valve 200, port 1, preferably about 2 mL at about 10 mL/min flow rate.

4a.4. Eluent is pulled into the tubing segment 102 through valve 200, port 3, preferably about 8 mL portion of about 0.1 M sodium acetate at about 18 mL/min flow rate.

4a.5. The eluent is expelled from the tubing segment 102 through the separator 302 (valve 200, port 6) to product vial 306 (valve 304, port 3), preferably about 8 mL of about 0.1 M sodium acetate at about 1 mL/min flow rate.

4a.6. Air is dispensed, preferably about 1.9 mL at about 4 mL/min flow rate.

4a.7. Valve 200 is switched to waste (port 7) and remaining air (about 0.1 mL) is expelled from the tubing segment 102 to waste, followed by about 0.5 mL of carrier solution. The flow rate is about 10 mL/min.

At this point the Bi-213 product is eluted from the anion exchange membrane in the separator 302 and collected in the product vial 306. The separator 302 and all transport lines are flushed with air. The system is ready for the next separation run.

4b. Bi-213 elution sequence (sequential)

4b.1 Valve 200 is switched to air position (port 1). Valve 304 is switched to product position (port 3).

4b.2 Air is aspirated into the tube segment 102 through valve 200, port 1, preferably about 1 mL at about 10 mL/min.

4b.3 Valve 200 is switched to eluent position (port 4). About 4 mL of about 0.1 M NaOAc is pulled into the tubing segment at about 20 mL/min.

4b.4 Two-position valve 310 is switched to down-flow position (ports 1 and 2 are connected). Note that flow direction is opposite relative to Ac-225 load and membrane scrub(wash) steps.

4b.5 Valve 200 is switched to separator position (port 6). About 5 mL is expelled from the tubing segment 102 through the separator 302 to product vial 308 (Valve 304, port 3) at about 1 mL/min (down-flow direction).

4b.6 Valve 200 is switched to "air" position (port 1). About 5 mL of air is aspirated into the tubing segment 102 at about 18 mL/min.

4b.7 Valve 200 is switched to separator position. About 5 mL of air is expelled from the tubing segment 102 to product vial 308 (port 3, valve 304) at about 15 mL/min.

After the membrane is replaced or possibly washed for reuse, the instrument is ready to proceed with a next separation.

Experimental Equipment and Procedure

All reagent and transport lines were constructed from 0.8 mm i.d. FEP TEFLON® tubing (Upchurch Scientific, Oak Harbor Wash.). The holding coil was made of 1.6 mm i.d. FEP tubing (Upchurch). The length of the tubing segment 102 was 6.25 m (calculated volume 12.5 mL) and wound into a coil. The purpose of the tubing segment 102 is to accommodate reagent solutions required in the separation run without their introduction into the syringe pump. All necessary reagents including the "cow" solution were placed around Valve 200. Valve 304 was used to collect the effluents into separate vials or direct them to waste.

The efficiency of the automated separations was monitored using a portable high purity germanium (HPGe) gamma-spectroscopy unit. The Bi-213 product fractions, scrub fractions, and Ac-225 "cow" solutions were collected and counted to estimate Bi-213 recovery and purity, and Ac-225 losses during the separation run. The counting experiments were performed using standard procedures.

EXAMPLE 1

An experiment was conducted using the apparatus and stacked method of the present invention to demonstrate separation of about 3 milli-curie Bi-213 from Ac-225.

A 25 mm anion exchange membrane disc (3M Company, St. Paul Minn.) was used as separation media in the separator 302. Because of the low activity of the radionuclides, low pressure valves (500 psi gas pressure rating) were used.

Figure 4A:
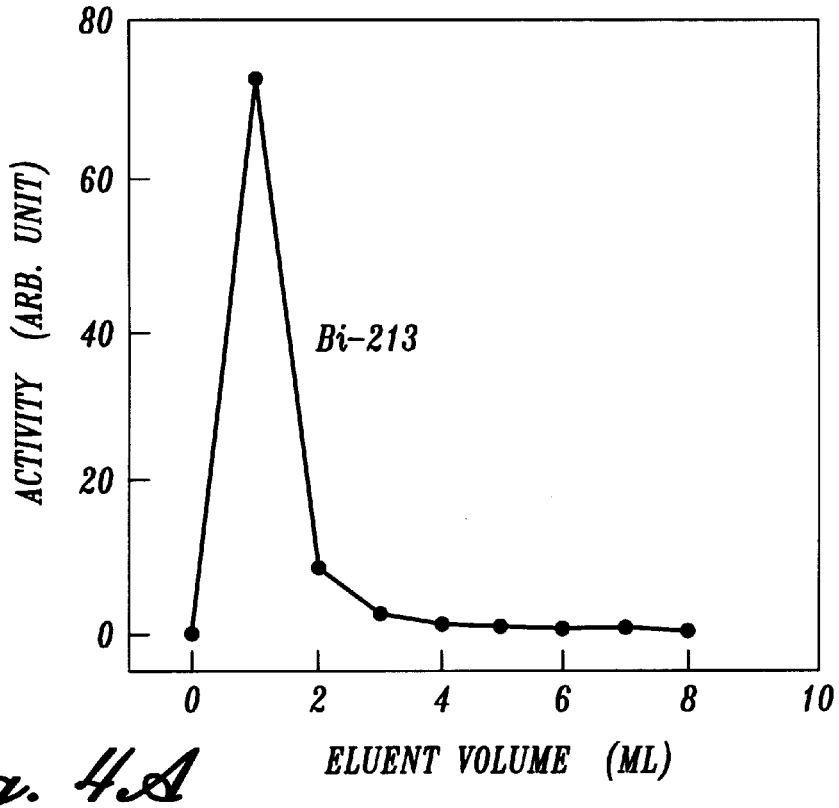
FIG. 4*a* is a graph of activity versus eluent volume, elution profile. (Ex. 1)
Figure 4B:
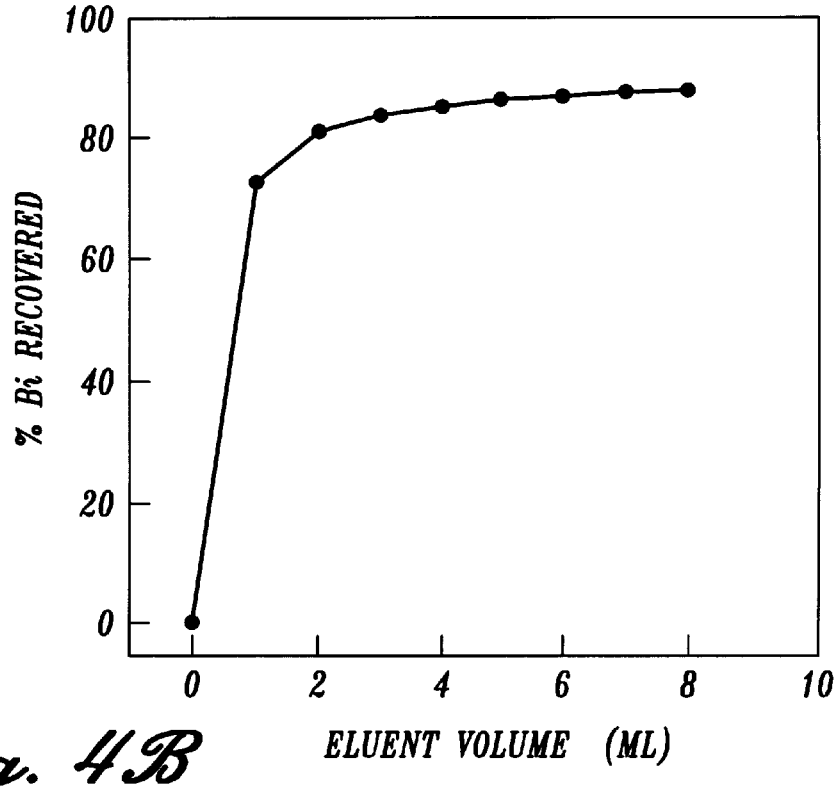
FIG. 4*b* is a graph of %Bi recovered versus eluent volume. (Ex. 1)

Table E1-1 and FIGS. 4*a*, 4*b* show results. The eluent fractions were collected in 1 mL increments in order to evaluate the elution profile of Bi-213. The gamma spectroscopy indicated that Ac-225 "cow" solution was quantitatively (within counting errors) recovered in the original storage container. Good product recovery was achieved using 0.1 M sodium acetate eluent. FIG. 4*a* shows that Bi-213 elution provides about 73% of Bi-213 activity recovered in first mL of the eluent solution. FIG. 4*b* shows that over 87% of the Bi-213 product was recovered with 4 mL of the sodium acetate eluent.

TABLE E1-1

Results of the automated separation experiment using ion exchange membrane

| | Solution | Ac-225 | Bi-213 |
|---|---|---|---|
| Feed | 3 mL 0.5 M HCl tracer Ac-225/Bi213 | 102% | 0% |
| Scrub | 4 mL 0.005 M HCl | Not detected | 1.51% |
| Strip | 8 mL 0.1 M NaOAc | Not detected | 90.3% |
| Membrane | | Not detected | 4.36% |
| Product Balance | | | 96.17% |

EXAMPLE 2

An experiment was conducted with the apparatus and stacked method of the present invention wherein the separator 302 had a miniature anion exchange column instead of an anion exchange membrane. Valves were as in Example 1.

The miniature sorbent column was constructed from 1.6 mm i.d. FEP tubing (Upchurch) using ¼-28 flangeless connectors and fittings (Upchurch), and 25 $\mu$m FEP frits (Alltech Associates, Deerfield, Ill.). The length of the column was 3 cm (calculated volume 0.06 mL). The column was packed with surface derivatized styrene-based strongly basic anion exchanger particles (particle size 50 $\mu$m) in $Cl^-$ form obtained from an OnGuard®-A column (ONGUARD is a registered trademark of Dionex Corporation).

The volume of an air segment used to separate aspirated zones was 2 mL. Reagent volumes and flow rates for the column separation experiment are listed in Table E2-1.

Just as before, the flow direction for the elution step was reversed. The eluent fractions were collected in 1 mL increments. The separation was performed using a 3 mL of the cow solution containing tracer quantities of Ac-225/Bi-213. However, only ca. 2 mL of the cow solution was used in the run (due to a programming error). In order to assess the effectiveness of the separation procedure, the used portion of the cow was recovered in a separate vial.

TABLE E2-1

Separation parameters of the column experiment

| Step | Reagent | Volume | Flow Rate |
|---|---|---|---|
| Column conditioning | 0.5 M HCl | 2 mL | 1 mL |
| Cow load | 0.5 M HCl tracer Ac-225/Bi213 | c.a. 2 mL | 1 mL/min |
| Scrub | 0.005 M HCl | 0.5 mL | 1 mL/min |
| Bi elution (flow direction reversed) | 0.1 M NaOAc | 3 mL | 0.5 mL/min |

Results of the automated Bi-213 separation using a miniature ion exchange column are given in Table E2-2.

TABLE E2-2

| Results of the automated separation experiments using 50 μL ion exchange column | | | |
|---|---|---|---|
| | Solution | Ac-225 | Bi-213 |
| Feed | 2 mL 0.5 M HCl tracer Ac-225/Bi213 | 101% | 0% |
| Scrub | 0.5 mL 0.005 M HCl | Not detected | 1.51% |
| Strip | 3 MI 0.1 M NaOAc | Not detected | 94% |
| Column | | Not detected | 5.7% |
| Product Balance | | | 101.2% |

Just as in case of a membrane separation, the Ac-225 "cow" recovery was quantitative within the counting errors. Good product recovery was obtained. First mL of the product eluent contained ca. 70% of the product activity. Approximately 94% of the Bi-213 product was recovered with 3 mL of 0.1 M sodium acetate eluent. These preliminary results demonstrate that automated Bi-213 production can be efficiently carried using a miniature ion exchange column. The choice of the sorbent (surface functionalized, non porous ion exchanger beads) provides fast exchange kinetics. Moreover, it was observed that miniature column is very efficiently flushed with air which removes any interstitial liquid. This is advantageous for the recovery of a "cow" solution. Furthermore, the dead volumes of the column reactor were substantially smaller relative to a membrane disk used in a previous experiment. This is desirable for high separation factors.

In supplementary experiments we evaluated performance of a commercially available tapered microcolumn (0.05 mL volume) packed with On-Guard-A ion exchange beads. The "cow" and scrub solutions were loaded on the narrow end, while the elution step was carried out from wider end. Experimental results (Bi recovery and elution profile) were comparable with those obtained using non-tapered column.

EXAMPLE 3

Experiments were conducted to demonstrate automated separation of Bi-213 using about 16 mCi of Ac-225. The ~16 mCi of $^{225}$Ac was received from ORNL as a dried chloride salt in a V-vial as shown in Table 3-1. The $^{225}$Ac was dissolved in 3.1 mL of 0.5M HCl and sampled. The $^{225}$Ac received was found to be 16.35 mCi. The $^{225}$Ac to $^{225}$Ra ratio was 391 as compared to product $^{225}$Ac of >1,068. The $^{225}$Ac to $^{229}$Th ratio was determined as 2.54 E+4. The ICP analysis shows contamination from Al and Cr. This contamination is equal to 0.07 mg Al and 0.005 mg Cr per mCi of $^{225}$Ac.

A 25 mm anion exchange membrane disc (3M Company, St. Paul Minn.) was used as separation media in the separator 302 as in Example 1. However, high pressure valves (5000 psi gas pressure rating) were used because of the greater radionuclide activity compared to Examples 1 and 2.

The experimental procedure used in this experiment was sequential, mimicking a manual operation. Thus, Ac-225 "cow" and scrub (wash) solutions were not stacked in the tubing segment 102 as in Examples 1 and 2, but rather "cow" and scrub solutions were aspirated and delivered sequentially.

TABLE E3-1

| Analysis of ORNL $^{225}$Ac Feed | | | |
|---|---|---|---|
| | Isotope | Activity | Ratio Ac-225/Isotope |
| At 10:34 12/16/97 | Ac-225 | 16.35 mCi | 1 |
| | Bi-213 | 17.2 mCi | ~1 |
| | Ra-225 | 0.059 mCi | 391 |
| | Th-229 | <0.64 μCi | 2.54E + 4 |
| | Pu239/240 | <0.062 mCi | >264 |
| ICP Analysis | | | |
| (3 mL feed: 16.35 mCi) | Al | 391 ppm | |
| | Cr | 27 ppm | |
| | Other | <detectable | |

A 0.25 mL air segment was placed into the tubing segment 102 in the beginning of the separation procedure and was not expelled until the end of the separation run. The volume of the air segment used to separate zones in the holding coil was 1 mL. This air segment was propelled through the membrane to recover solutions. Following the solution delivery, additional volume of air (10 mL) was pulled into the coil and delivered through the membrane to ensure complete removal of liquid from the membrane disc and transport lines. The separation run starts with the membrane disk and all transport lines filled with air.

The membrane disc is positioned vertically, luer adapter side at the top. The 3M disc was washed with 0.005M HCl to remove the interstitial feed and acid. The sorbed $^{213}$Bi chloro complexed anion was then eluted at 1 mL/min increments using 0.1M NaOAc, pH 5.5. The 3M web (after elution), the 4 ml of wash solution, and each of the 1 mL effluent fractions were sampled and counted using the portable GEA system. A sample (10 μL) of the first 1 mL of effluent was sent to the analytical laboratory for complete analysis; and the balance of the 1 mL was used for linking studies. The above test was repeated after approximately 3 hours of $^{213}$Bi in-growth. The conditions and results are shown in Table E3-2.

TABLE E3-2

| Elution Conditions and Results | |
|---|---|
| Conditioning: | 5 mL of 0.5 M HCl @ 10 mL/min. |
| $^{225}$Ac "Cow": | 3 mL of 0.5 M HCl, ~16 mCi $^{225}$Ac, @ 4 mL/min. |
| Wash Solution: | 4 mL of 0.005 M HCl, @ 10 mL/min. |
| Elution: | 4 mL of 0.1 M Na acetate, pH ~5.5, @ 1 mL/min. |

TABLE E3-3

| Elution Test Results | |
|---|---|
| Elution, 1 mL | #1 % Bi |
| 1 | 69.8 |
| 2 | 11.9 |
| 3 | 4.0 |
| 4 | 2.1 |
| 3M Web | 8.6 |
| Wash, 4 mL | 2.5 |
| Material | 99.9 |

Balance

Figure 5A:
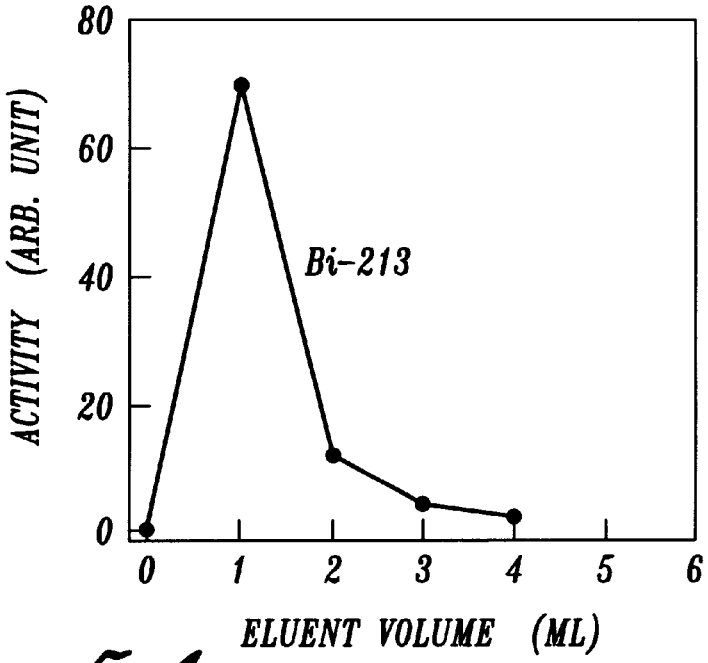
FIG. 5*a* is a graph of activity versus eluent volume, elution profile. (Ex. 3)
Figure 5B:
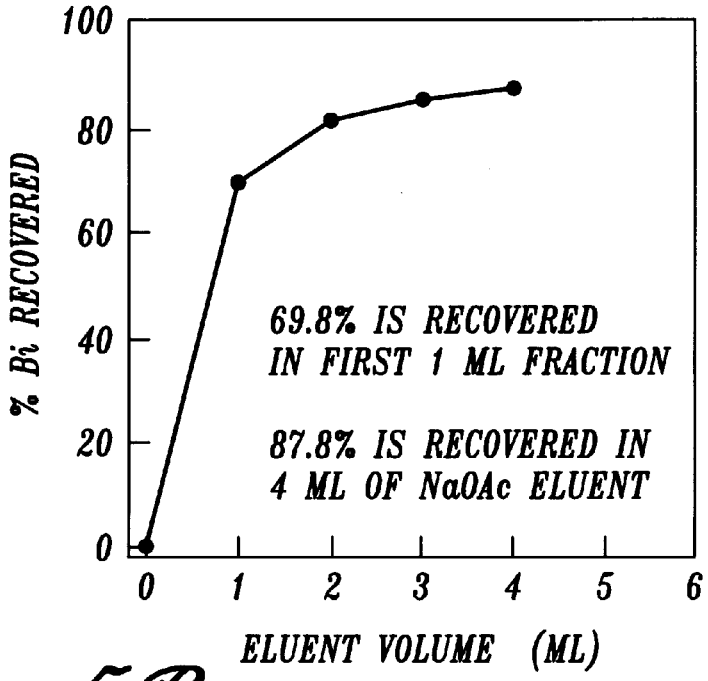
FIG. 5*b* is a graph of %Bi recovered versus eluent volume. (Ex. 3)

Experimental procedure outlined above was applied to separate Bi-213 from 16 mCi of Ac-225. Approximately, 88% of the $^{213}$Bi was recovered in 4 mL of 0.1M NaOAc, pH 5.5, FIGS. 5*a,* 5*b*. Approximately 80% of the recovered Bi-213 was present in the first milliliter of the eluent solution.

EXAMPLE 4

Two experiments were conducted demonstrating linking of the $^{213}$Bi products from Example 3. The two proteins included a canine monoclonal antibody CA12.10C12 which is reactive with the CD45 antigen on hematopoietic cells and recombinant streptavidin (r-Sav). The r-Sav was midified with 1.5 CHX-B DTPA chelates/molecule. In each labeling/linking reaction, a 200 μg quantity of r-Sav in 120 μL phosphate buffered saline solution (PBS) was used. The anti-CD45 canine monoclonal antibody was modified with a 3.6 CHX-B DTPA chelates/molecule. In each reaction, a 100 μg quantity of monoclonal antibody in 120 μL of PBS was used. The 120 μL of protein solution was mixed with 100 μL of 1 M NaOAc, pH 5, and ~300 μL of $^{213}$Bi from the first fraction of eluent. An initial determination of the amount of radioactivity was determined using a Capintec CRC-7 dose calibrator. After 10 minutes reaction time, the mixture was placed on the top of a NAP-10 (G-25) size exclusion column and eluted. Elution fractions (200 μL of PBS each) were collected in separate micro centrifuge tubes and counted. The empty reaction vial and the eluted NPA-10 column were also counted. The empty reaction vial and the eluted NPA-10 column were also counted. The counting results were decay corrected for the half-life of $^{213}$Bi, and a radioactivity balance was determined. Results from two runs are shown in Tables 4-1 and 4-2.

TABLE 4-1

Labeling Results Using PNNL Run #1

Protein - 120 μL (200 μg r-SAv)
Buffer - 100 μL, 1 M NaOAc, pH 4
300 μL, $^{213}$Bi containing 2.36 mCi
Results:

| | Time | Capintec CRC-7 Reading | Corrected Reading | % of Initial |
|---|---|---|---|---|
| Initial | 11:50 | 256 | 256 | |
| 1-1 | 12:21 | 0.2 | 0.3 | 0.1 |
| 1-2 | 12:22 | 0.0 | 0 | 0 |
| 1-3 | 12:23 | 0.2 | 0.3 | 0.3 |
| 1-4 | 12:25 | 0.5 | 0.83 | 0.3 |
| 1-5 | 12:27 | 8.3 | 14.2 | 5.5 |
| 1-6 | 12:30 | 32.3 | 56.7 | 22.1 |
| 1-7 | 12:32 | 46.2 | 84 | 32.8 |
| 1-8 | 12:34 | 32.3 | 61 | 23.8 |
| 1-9 | 12:35 | 13.8 | 26.3 | 10.3 |
| Column | 12:39 | 4.0 | 8.2 | 3.2 |
| | | | 251.7[A] | |
| 1-7 Rerun | 12:37 | 43.0 | 84.3 | Balance |

[A]98.3% Activity

TABLE 4-2

Labeling Results Using PNNL Run #2

Protein - 120 μL (100 μg anti-CD45 canine mAb)
Buffer -100 μL, 1 M NaOAc, pH 4
200 μL, containing 1.9 mCi $^{213}$Bi
Results:

| | Time | Reading | Corrected Reading | % of Initial |
|---|---|---|---|---|
| Initial | 2:06 | 207 | 207 | |
| 2-1 | 2:34 | 0.2 | 0.3 | 0.15 |
| 2-2 | 2:35 | 0.1 | 0.15 | 0 |
| 2-3 | 2:36 | 0.1 | 0.15 | 0 |
| 2-4 | 2:37 | 0.1 | 0.17 | 0.08 |
| 2-5 | 2:37 | 6.1 | 9.5 | 4.7 |
| 2-6 | 2:38 | 24.6 | 39.0 | 19.3 |

TABLE 4-2-continued

Labeling Results Using PNNL Run #2

Protein - 120 μL (100 μg anti-CD45 canine mAb)
Buffer -100 μL, 1 M NaOAc, pH 4
200 μL, containing 1.9 mCi $^{213}$Bi
Results:

| | Time | Reading | Corrected Reading | % of Initial |
|---|---|---|---|---|
| 2-7 | 2:39 | 33.0 | 52.8 | 26.2 |
| 2-8 | 2:39 | 22.2 | 35.5 | 17.6 |
| 2-9 | 2:40 | 7.4 | 12.0 | 6.0 |
| 2-10 | 2:40 | 2.4 | 3.9 | 1.9 |
| 2-11 | 2:41 | 1.7 | 2.8 | 1.4 |
| Column | 2:31 | 20.9 | 30.0 | 14.8 |
| Vial | 2:41 | 9.4 | 15.4 | 7.6 |
| | | | 201.7 | 99.7% Activity Balance |

After purification on NAP-10 columns, 72% (1.7 mCi) of the $^{213}$Bi labeled with r-Sav, and 69% (1.31 mCi) labeled with anti-CD45 canine mAb, 12.10C12. These percentages are derived from the data in Tables 4-1 and 4-2 and are sufficient for therapeutic use.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for separating a short lived daughter isotope from a long lived parent isotope, comprising the steps of:

(a) filling a bi-directional pump and a tubing segment connected thereto with a buffer liquid;

(b) drawing a volume of a gas in contact with the buffer liquid by withdrawing a first amount of said liquid buffer;

(c) drawing a first liquid sample of a mixture of said short lived daughter isotope and said long lived parent isotope into the tubing segment by withdrawing a second amount of the buffer liquid, wherein said first liquid sample is separated from said buffer liquid by the volume of the gas; and (d) passing said first liquid sample through a separator to obtain the short lived daughter isotope.

2. The method as recited in claim 1, further comprising drawing a second liquid into the tubing segment either by a stacked method or a sequential method.

3. The method as recited in claim 2, wherein said stacked method comprises the steps of:

separator conditioning, scrub loading, cow loading, cow delivery through the separator, and elution or daughter collection.

4. The method as recited in claim 3, wherein separator conditioning comprises the steps of:

2a.1. drawing a gas into the tubing segment through a first multiposition valve;

2a.2. drawing a separator conditioning reagent into the tubing segment through a reagent port on the first multiposition valve;

2a.3. expelling the separator conditioning reagent from the tubing segment, through the first multiposition valve, through the separator to a waste port on a second multiposition valve and expelling the gas behind the separator conditioning reagent;

2a.4. switching the first multiposition valve to a waste port position and expelling remaining gas from the tubing segment to a waste port on the first multiposition valve, followed by expelling a carrier solution; and 2a.5. filling the separator and transport lines with the gas.

5. The method as recited in claim 4, wherein said scrub loading comprises the steps of:

3a.5. placing the second multiposition valve in a cow port position;

3a.6. placing the first multiposition valve in a separator port position;

3a.8 delivering a cow solution and air to the separator, wherein the short lived daughter isotope is retained within the separator for subsequent elution or daughter collection, and directing the effluent to a cow storage container or reservoir through the second multiposition valve;

3a.9. placing both the first and second multiposition valves in a scrub port position;

3a.10. delivering a scrub solution and air through the separator to a scrub port on the second multiposition valve; and 3a.11. switching the first multiposition valve to the waste port position and expelling remaining air from the tubing segment to the waste port on the first multiposition valve, followed by a carrier solution.

6. The method as recited in claim 5, wherein elution comprises the steps of:

4a.1. reversing flow direction through the separator;

4a.2 placing the second multiposition valve in a product port position;

4a.3. drawing an air segment into the tubing segment through the first multiposition valve;

4a.4. drawing an eluent into the tubing segment through the first multiposition valve;

4a.5. expelling the eluent from the tubing segment through the first multiposition valve, through the separator, wherein the short lived daughter isotope is eluted from the separator, and through the second multiposition valve to a product vial;

4a.6. dispensing air through the tubing segment after the eluent; and 4a.7. switching the first multiposition valve to the waste port position and expelling remaining air from the tubing segment to the waste port on the first multiposition valve, followed by flushing a carrier solution.

7. The method as recited in claim 2, wherein said sequential method comprises the steps of:

initializing, conditioning the separator, loading and delivering cow and scrub solutions, and eluting a short lived daughter isotope from a long lived parent isotope.

8. The method as recited in claim 7, wherein said initializing comprises the steps of:

1.1 setting the first multiposition valve in a waste port position and emptying a syringe; and 1.2 aspirating an air segment into the tubing segment.

9. The method as recited in claim 2, wherein said sequential method comprises the steps of:

conditioning the separator, loading and delivering and scrub solutions, and eluting a short lived daughter isotope.

10. The method as recited in claim 9, wherein said conditioning the separator comprises the steps of:

2b.1 drawing a gas into the tubing segment through a first multiposition valve;

2b.2 aspirating a separator conditioning reagent through the first multiposition valve into the tubing segment;

2b.3 expelling the separator conditioning reagent from the tubing segment through [a] the separator followed by expelling air;

2b.4 aspirating air through the first multiposition valve into the tubing segment; and 2b.5 switching the first multiposition valve to a separator port position and expelling air through the separator.

11. The method as recited in claim 9, wherein loading and delivering cow solution comprises the steps of:

3b.1 aspirating air through a first multiposition valve into the tubing segment;

3b.2 switching the first multipostion valve to a cow port position and drawing a cow solution into the tubing segment;

3b.4 switching the first multiposition valve to a separator port position and switching a second multiposition valve to a cow return port position;

3b.5 expelling the cow solution from the tubing segment through the separator to a cow storage vial;

3b.6 switching the first multiposition valve to an air port position and aspirating air into the tubing segment;

3b.7 switching the first multiposition valve to the separator port position; and 3b.8 expelling the air from the tubing segment to the cow storage vial.

12. The method as recited in claim 11, wherein loading and delivering scrub solution comprises the steps of:

3b.9 switching the first multiposition valve to the air port position and switching the second multiposition valve to a scrub port position;

3b.10 aspirating air into the tubing segment through the first multiposition valve;

3b.11 switching the first multiposition valve to a scrub port position and drawing a scrub solution into the tubing segment;

3b.12 switching the first mulitposition valve to the separator port position, expelling the scrub solution from the tubing segment through the separator to a scrub port on the second multiposition valve;

3b.13 switching the first multiposition valve to the air port position and aspirating air into the tubing segment; and 3b.14 switching the first multiposition valve to the separator port position and expelling air from the tubing segment, through the separator, to a waste port on the second multiposition valve.

13. The method as recited in claim 12, wherein eluting a short lived daughter isotope comprises the steps of:

4b.1 switching the first multiposition valve to the air port position and switching the second multiposition valve to a product port position;

4b.2 aspirating air into the tube segment through the first multiposition valve;

4b.3 switching the first multiposition valve to an eluent port position and drawing an eluent solution into the tubing segment;

4b.5 switching the first multiposition valve to the separator port position and expelling the eluent solution from the tubing segment through the separator to a product vial through the second multiposition valve;

4b.6 switching the first multiposition valve to the air port position and aspirating air into the tubing segment; and 4b.7 switching the first multiposition valve to the separator port position and expelling the air from the tubing segment to the product vial.

14. The method as recited in claim 1, wherein said short lived daughter isotope comprises Bi-213 and said long lived parent isotope comprises Ac-225.

15. The method as recited in claim 1, wherein said separator is selected from the group consisting of an anion exchange column and an anion exchange membrane.

* * * * *